US006745897B2

(12) United States Patent
Barber et al.

(10) Patent No.: US 6,745,897 B2
(45) **Date of Patent: *Jun. 8, 2004**

(54) PERSONAL COMPUTER STORAGE AND SECURITY CASE

(75) Inventors: Peter M. Barber, Fergus (CA); Vernon W. Tarbutt, Kitchener (CA)

(73) Assignee: CompX International Inc., Mauldin, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/288,187

(22) Filed: Nov. 5, 2002

(65) Prior Publication Data

US 2003/0070948 A1 Apr. 17, 2003

Related U.S. Application Data

(63) Continuation-in-part of application No. 10/090,528, filed on Mar. 4, 2002, now Pat. No. 6,547,071, which is a continuation of application No. 09/767,178, filed on Jan. 22, 2001, now Pat. No. 6,352,155.

(51) Int. Cl.[7] ..... B65D 85/00

(52) U.S. Cl. ..... 206/320; 206/752; 206/762; 312/208.4

(58) Field of Search ..... 206/320, 747, 206/942, 752, 754, 755, 762, 764, 749; 312/126, 127, 139.1, 208.1, 208.3, 208.4, 208.5, 270.1, 309; 190/102

(56) References Cited

U.S. PATENT DOCUMENTS

| | | | | | |
|---|---|---|---|---|---|
| 5,400,903 | A | * | 3/1995 | Cooley | 206/320 |
| 5,871,094 | A | * | 2/1999 | Leibowitz | 206/320 |
| 6,036,011 | A | * | 3/2000 | DeCurtis et al. | 206/320 |
| 6,269,948 | B1 | * | 8/2001 | Jackson | 206/320 |
| 6,352,155 | B1 | * | 3/2002 | Barber | 206/320 |
| 6,547,071 | B2 | * | 4/2003 | Barber | 206/320 |

* cited by examiner

*Primary Examiner*—Shian Luong
(74) *Attorney, Agent, or Firm*—Banner & Witcoff, Ltd.

(57) ABSTRACT

A storage and security case for a personal computer comprises a housing with fold over side platforms, which operate a mechanism to raise and lower a support platform within the case to cover a personal computer stored within the case or expose the personal computer. The side platforms provide additional functions such as a storage tray for various materials and a mouse platform.

14 Claims, 12 Drawing Sheets

PERSONAL COMPUTER STORAGE AND SECURITY CASE

CROSS REFERENCE TO RELATED APPLICATIONS

This is a continuation in part of U.S. application Ser. No. 10/090,528 Filed Mar. 4, 2002, now U.S. Pat. No. 6,547,071 entitled Personal Computer Storage and Security Case, which is a continuation of Ser. No. 09/767,178, filed on Jan. 22, 2001 now U.S. Pat. No. 6,352,155 issued Mar. 5, 2002 entitled Personal Computer Storage and Security Case both for which priority is claimed.

BACKGROUND OF THE INVENTION

In a principal aspect, the present invention relates to a storage and security case for a personal computer, laptop computer, or other desktop item which may be subject to theft and therefore may require a means to provide for security of the stored item while maintaining ease of access for use of the item.

Personal computers (laptops) have the capability of easy removal and transport from a desktop support arm or desktop environment so that they may be transported by the user for use at a remote site. However, the removal of a personal computer (PC) and accompaniment thereof with its owner or user is not always desirable or practical. Thus, often a PC will be left at its desktop location or station while the owner is absent from that workstation. When the owner is not present, the personal computer is subject to theft or unauthorized use. To overcome theft and misuse opportunities, various types of locking mechanisms have been developed for the personal computer to retain it securely at a workstation. For example, a cable with a lock is often attached to a computer case and locked into position at a workstation. To remove the personal computer, it is then necessary to use a key to release the cable lock, detach the cable and remove the computer and the attached cable from that workstation. Such security measures are useful and do provide a significant inhibition to personal computer theft. Nonetheless, there has remained the need for an improved method to enhance the security of personal computers or other items maintained at a workstation. Such a system should be simple to use and highly convenient.

SUMMARY OF THE INVENTION

Briefly, the present invention comprises a storage and security case for a personal computer comprised of a generally rectangular parallelpiped enclosure including a base, front and back panels, as well as foldable side panels. The foldable side panels are designed to fold and fit over the top of a personal computer or other item stored within the case. Folding or pivoting the side panels from a position which covers the personal computer to a position wherein the side panels extend laterally from the sides of the case exposes the interior of the case and simultaneously causes a base plate within the interior of the case to automatically rise thereby raising the personal computer from the case for easy access by its user. Additionally, the front panel of the storage case may include a wrist pad so that the front panel may fold outwardly to support the wrists of the user which seeks to use the computer that has been raised from the case. The case includes a solid base plate which may be easily integrated with or attached to a keyboard support arm. The case may be removable from the support arm so that it may be carried by the user to provide an extra degree of security and protection when transporting the personal computer.

Additionally, the case may include a locking mechanism which holds the folding side panels in a closed position to retain the personal computer within the case.

Further, the case may be mounted on drawer slides and may include a locking mechanism for locking the case as well as for locking the slide mounted case in a drawer closed position.

Thus, it is an object of the invention to provide a storage and security case for personal computers which completely encapsulates and surrounds the personal computer in a protective environment and which may be locked, but which when unlocked, provides for easy accessibility to the personal computer.

It is a further object of the invention to provide an improved storage and security case for a personal computer which may be locked so as to retain the personal computer within the case protected from external access.

Another object of the invention is to provide a storage and security case for a personal computer which may be incorporated with and used in combination with a keyboard support arm or with drawer slides.

Yet another object and feature of the invention is to provide a storage and security case for a personal computer wherein a support plate within the case may operate to automatically raise the personal computer from within the case for easy access and use by the computer user.

A further object of the invention is to provide a storage and security case for a personal computer wherein pivotal side platforms move between a position which enshrouds or covers the personal computer to a position which totally exposes the computer and wherein the side platforms extend laterally from the opposite sides of a base plate which supports the computer.

Another object of the invention is to provide laterally projecting side platforms for a storage and security case for a personal computer wherein the side platforms serve as a support for a mouse or other elements associated with control and operation of the personal computer or which may also serve as storage trays for materials being used in association with the use of the personal computer.

Another object and feature of the invention is to provide an inexpensive yet highly secure and reliable and rugged security case for a personal computer which may be transported with the computer.

These and other objects, advantages and features of the invention will be set forth in the detailed description which follows.

BRIEF DESCRIPTION OF THE DRAWING

In the detailed description, which follows, reference will be made to the drawing comprised of the following figures.

DETAILED DESCRIPTION OF THE PREFERRED EMBODIMENT

Figure 1:
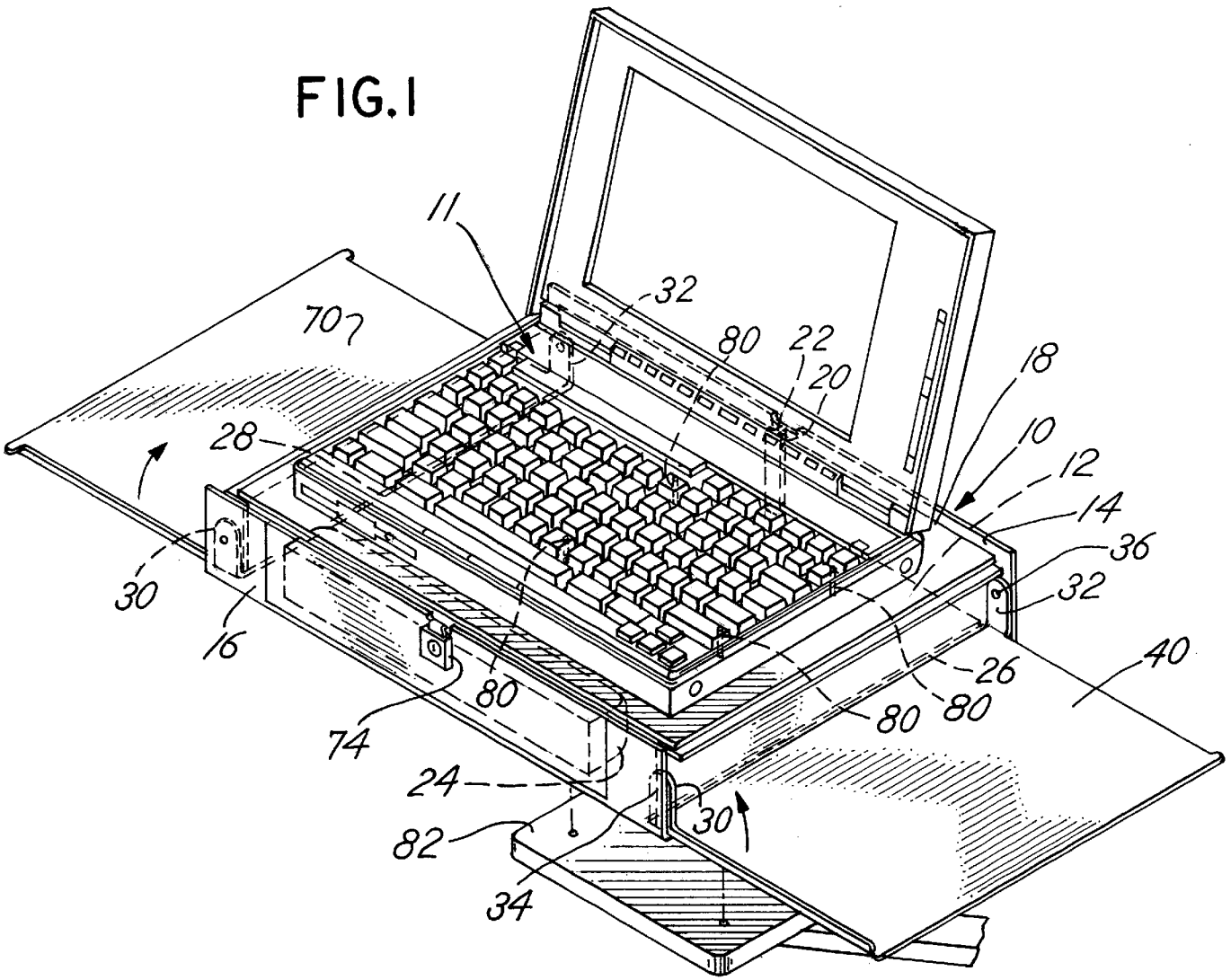
FIG. 1 is an isometric view of the personal computer storage and security case wherein portions thereof are partially cut away and wherein the security case is mounted on a keyboard support arm.

The storage and security case of the invention includes a housing 10, which comprises a planar, generally rectangular, base plate 12, a backside plate 14 and a front side plate 16. The base plate 12 is rectangular and is designed to be slightly larger than the profile defined by most personal computers. The size and configuration of the base plate 12, however, may be customized for any particular shape and personal computer size. The front and back sides 14 and 16 are generally rectangular and have a height greater than the thickness of a closed personal computer wherein the top and bottom halves of the computer have been folded together. Thus, the housing 10 defines an enclosure into which a personal computer 11 may be fitted.

A support plate 18 is positioned over the base plate 12. Support plate 18 has a shape which is generally rectangular. The support plate 18 preferably has a profile which fits within the profile of the base plate 12. Further, the support plate 18 typically includes a projecting aligning tab 20 along a back side which cooperates with a rib 22 on the inside of the back panel 14 to thereby retain the support plate 18 properly aligned within the cavity defined by the housing 10 as the support plate 18 moves vertically upwardly and downwardly in a manner to be described below. Again, the particular configuration and shape of the support plate 18 is optional. The function of the plate 18 is to support a personal computer 11 and to cause that personal computer 11 to rise in accord with the operation of the security case as described below. The utilization of a rib 22 and keyed projection or tab 20 as described also is optional and one or more of such keyed elements may be provided to facilitate alignment and movement of the base plate 18 over base plate 12.

Another optional feature of the housing 10 relates to the front panel 16. The panel 16 may be hinged to the base plate 12 so that it will pivot outwardly as depicted by the arrows in FIG. 1. Appropriate stops may be provided to limit the pivot movement of the front panel 16. The inside of the front panel 16 may include a wrist rest 24 shown in phantom in FIG. 1. Thus, the front panel 16 may be pivoted outwardly and partly downwardly, if desired to expose the wrist rest 24 so that a personal computer 11 retained within the case can be accessed and operated easily by an operator who will rest his or her wrists on the wrist rest 24. Front panel 16 may be actuated by a linkage or a cam mechanism linking side platforms 40, 70 (described below) to effect pivotal motion between a closed and open position.

The base plate 12 further includes a first side edge 26 and a second, parallel side edge 28 which extend between the front panel 16 and the back panel 14. The side edges 26 and 28 terminate at each end with upwardly extending hinge members 30 and 32 that include pivot pin openings 34 and 36 respectively. The hinge members 30 and 32 are thus integral with the front panels 16 and the back panel 14, although, in the event the front panel 16 is designed to be hinged to the base plate 12, then the hinge members 30 remain fixed and extending upwardly from the base plate or panel 12.

Figure 3:
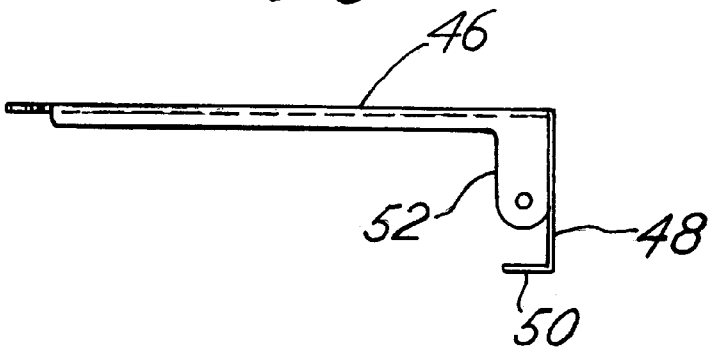
FIG. 3 is a side elevation of a first side platform associated with the assembly of FIG. 2.
Figure 4:
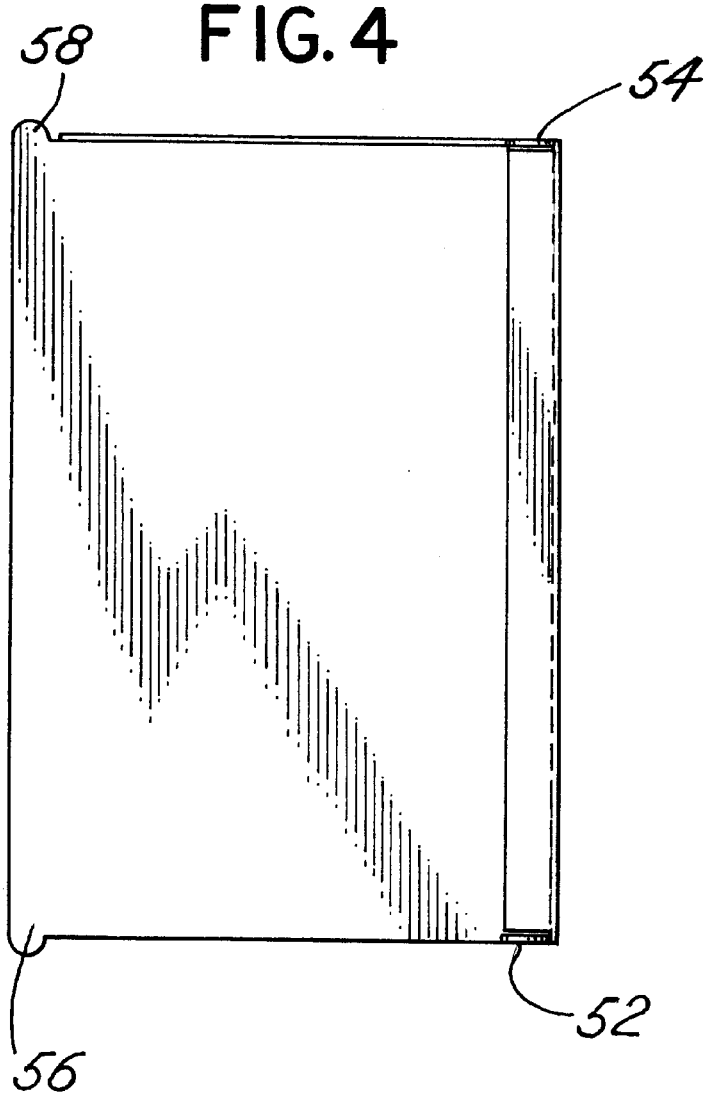
FIG. 4 is a top plan view of the side platform of FIG. 3.

A first side platform 40 is attached to the upwardly extending hinge members or sections 30 and 32 and thus is attached to the housing 10. More specifically, a first side panel 40 is depicted in greater detail in FIGS. 3 and 4 and includes a flat planar platform member 46, a depending side section 48, an inwardly extending cam member 50 and downwardly extending hinge sections 52 and 54 at the opposite ends thereof. As depicted in FIG. 4, the platform 46 also includes outwardly projecting stop members 56 and 58 which are designed to engage against the top edge of panels 16 and 14 respectively, when the platform 40 is in the position shown in FIG. 3 and before pivoting to the position shown in FIGS. 1 and 2.

Figure 2:
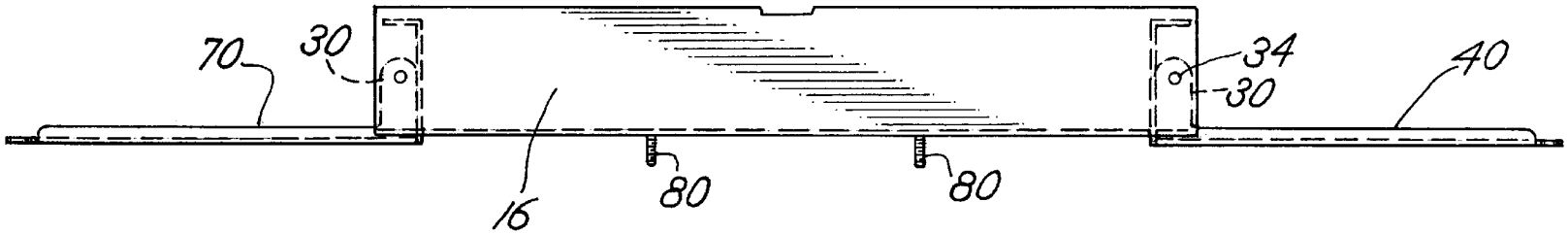
FIG. 2 is a front elevation of the assembly of FIG. 1.
Figure 6:
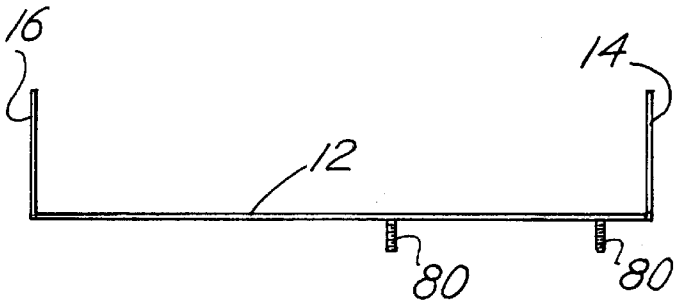
FIG. 6 is a front plan view of the housing of FIG. 5
Figure 5:
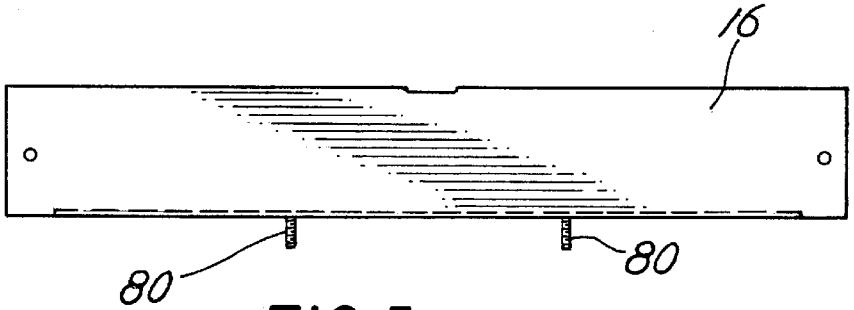
FIG. 5 is an end view of the housing including the base plate utilized in the assembly of FIGS. 1 and 2.

The first side platform 40 thus includes a platform section 46 which extends approximately one-half of the distance over the base plate 12 and support plate 18. Hinge pins attach the hinge members 52 and 54 through the hinge openings 34 and 36 so that the first platform 40 may be pivoted between a position which covers the base plate 12 and a position where it is fully open with respect to the base plate 12 as illustrated in FIGS. 1 and 2. Note that the edge of the side surface 48 engages against the edge 26 of the base plate 12 to limit the pivotal motion of the first platform 40 toward an open position. The component parts may be reinforced to rigidly hold these component parts in position. Additionally, the angle which the platform 40 forms with the base plate 12 may be controlled or adjusted by the position of the edge 26 and the side panel 48.

A second side platform 70 comprises a mirror image of the first platform 40 is provided for cooperation with the hinge members 30, 32 associated with the side edge 28 of the base 12 and operates in a similar fashion. The second platform 70 thus covers the left hand side of the base plate 12 and support plate 18. Support plate 18 is engaged by the camming face or surface 50 so that when the first platform 40 and second platform 70 are moved to the open position, the support plate 18 is raised by a camming action to thereby raise a personal computer 11 positioned on the support plate 18. The inward extension camming surface 50 also encloses a space or gap associated with the edges 26 and 28 between base 12 and platforms 40, 70 when the platforms 40 and 70 are in the closed position.

Projecting tabs 56 and 58 of platforms 40, 70 may be gripped or engaged by a lock 74 to hold the platforms 40 and 70 in the closed position. In this manner, the case defined by the described members comprises a security housing for the personal computer 11 precluding access and removal thereof. In practice, the base 12 may include downwardly projecting locking studs 80 which fit into a support platform 82 associated with a computer support arm assembly 84. Thus, the security case of the invention may be permanently affixed to a computer keyboard support platform. Alternatively, a locking mechanism may be associated with the studs 80 so that the case may be removed from the support arm 84 for transport of the case and its contents.

FIGS. 7–15 disclose an alternative embodiment of the invention, wherein the component parts comprising the invention are molded from a plastic material or fabricated from a combination of plastic and metal parts. As with the embodiment of FIGS. 1–6, the embodiment of FIGS. 7–15 is comprised of a base plate or panel 100, a front side or panel 102, a back side or panel 104, a first lateral side panel 108, and a second lateral side panel 110 generally parallel to and spaced from the first side panel 108. The panels 100, 102, 104, 108, and 110 together form a generally rectangular support case, storage case, or enclosure for a personal computer (PC) or some other item requiring security. A computer support plate or platform 112 having a profile that fits within the profile of the base plate 100 and defined enclosure is aligned and generally retained in parallel relationship overlying the base plate 100. The thickness of the support plate 112 is, of course, less than the height of the front panel 102, back panel 104, and the side panels 108 and 110. Thus, the support plate 112 fits within the case and supports a personal computer or other item thereon protected by the lateral side panels 108, 110 and the bottom side or base plate 100.

A first pivotal lateral side and top enclosure panel or platform 116 is pivotally attached to the first lateral side 108. A second pivotal lateral side and top enclosure panel or platform 118 is pivotally attached to the lateral side 110. The axes 115, 117 of the pivotal movement of the pivotal or foldable panels 116 and 118 are generally parallel and are equally spaced upwardly from the base panel 100. Thus, as depicted in the drawings, the platforms 116 and 118 may be pivoted about their respective pivot axes 115, 117 between an open position, for example, as shown in FIG. 7 to a fully closed position as shown in FIG. 8.

Figure 8:
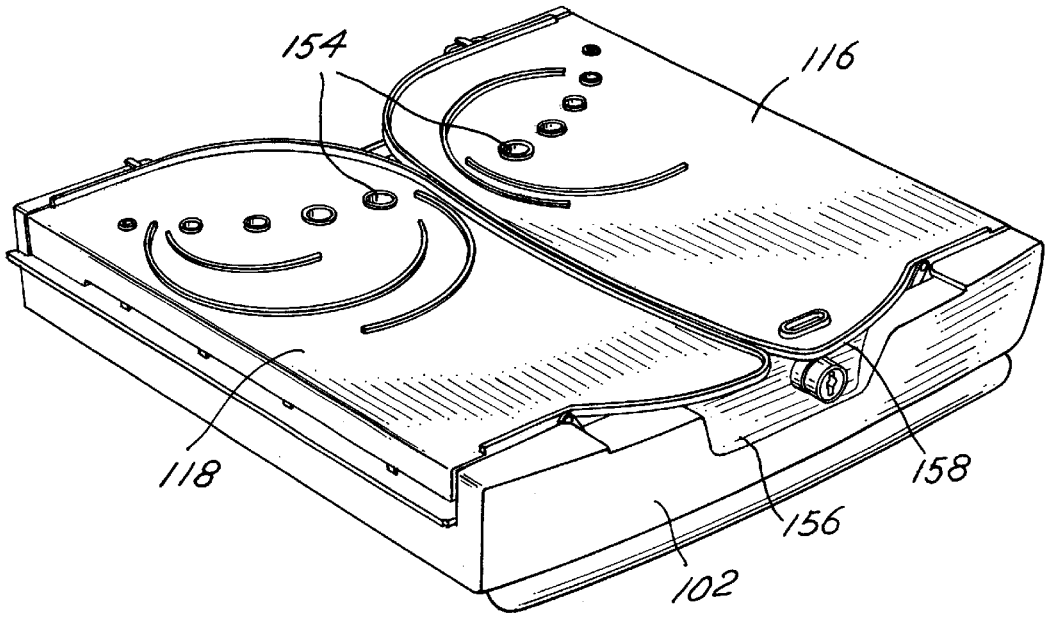
FIG. 8 is an isometric view of the embodiment of FIG. 7 wherein the lateral side platforms of the security case have been positioned in the closed position.
Figure 9:
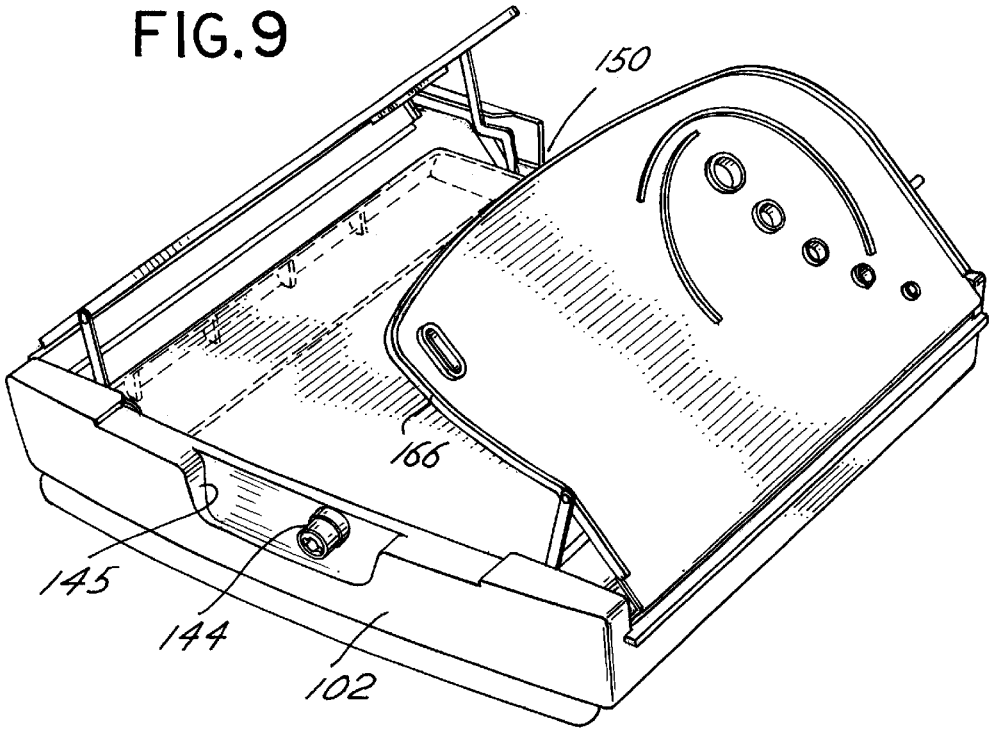
FIG. 9 is an isometric view similar to FIG. 8 wherein the lateral side platforms of the security case have been opened approximately 45°.
Figure 10:
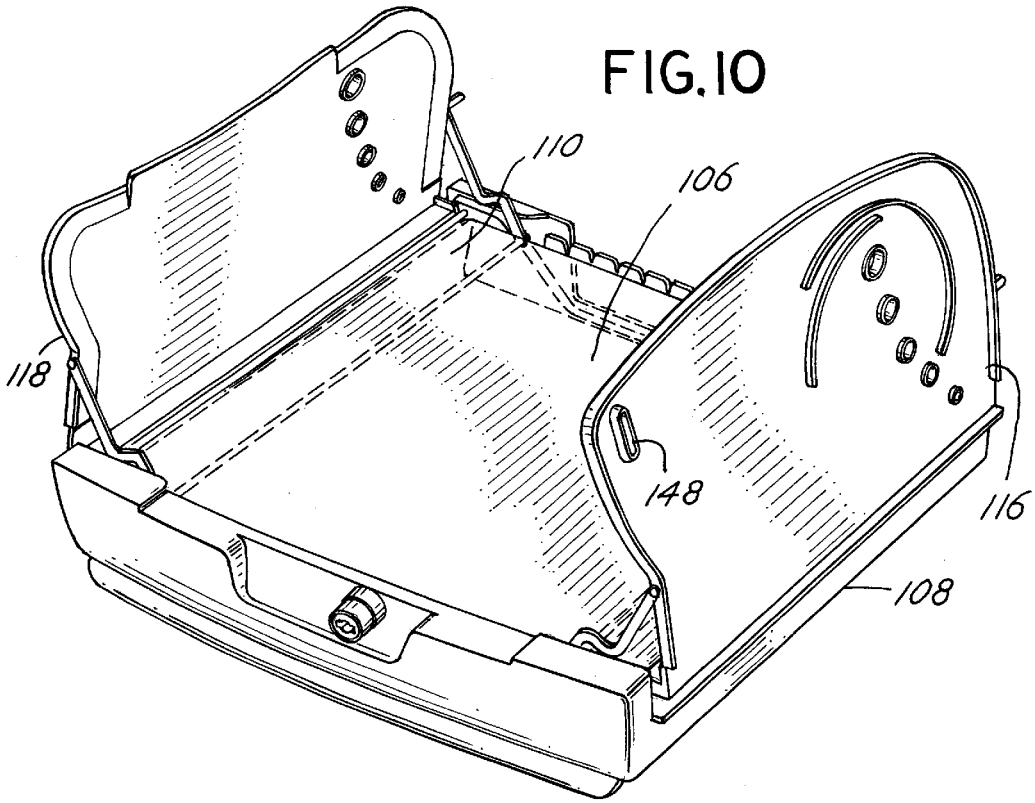
FIG. 10 is an isometric view similar to FIG. 9 wherein the side platforms of the security case have been opened approximately 80°.

The particular configuration of the platforms 116 and 118 may be varied in accord with design requirements and desires, but the panels or platforms 116 and 118 cover or close, at least in part, the open top of the computer case as depicted in FIG. 8. The relationship of the shape of the platforms or panels 116 and 118 may be adjusted for design reasons or other reasons. For example, one of the side panels 116 may be of reduced width and cover only a very small portion of the top of the case, while the other side panel may be lengthened to provide a larger side platform for the computer case. This variation may be undertaken to accommodate an oversized left-handed or right-handed platform for the security case. Other variations, including partial coverage, are possible.

Figure 7:
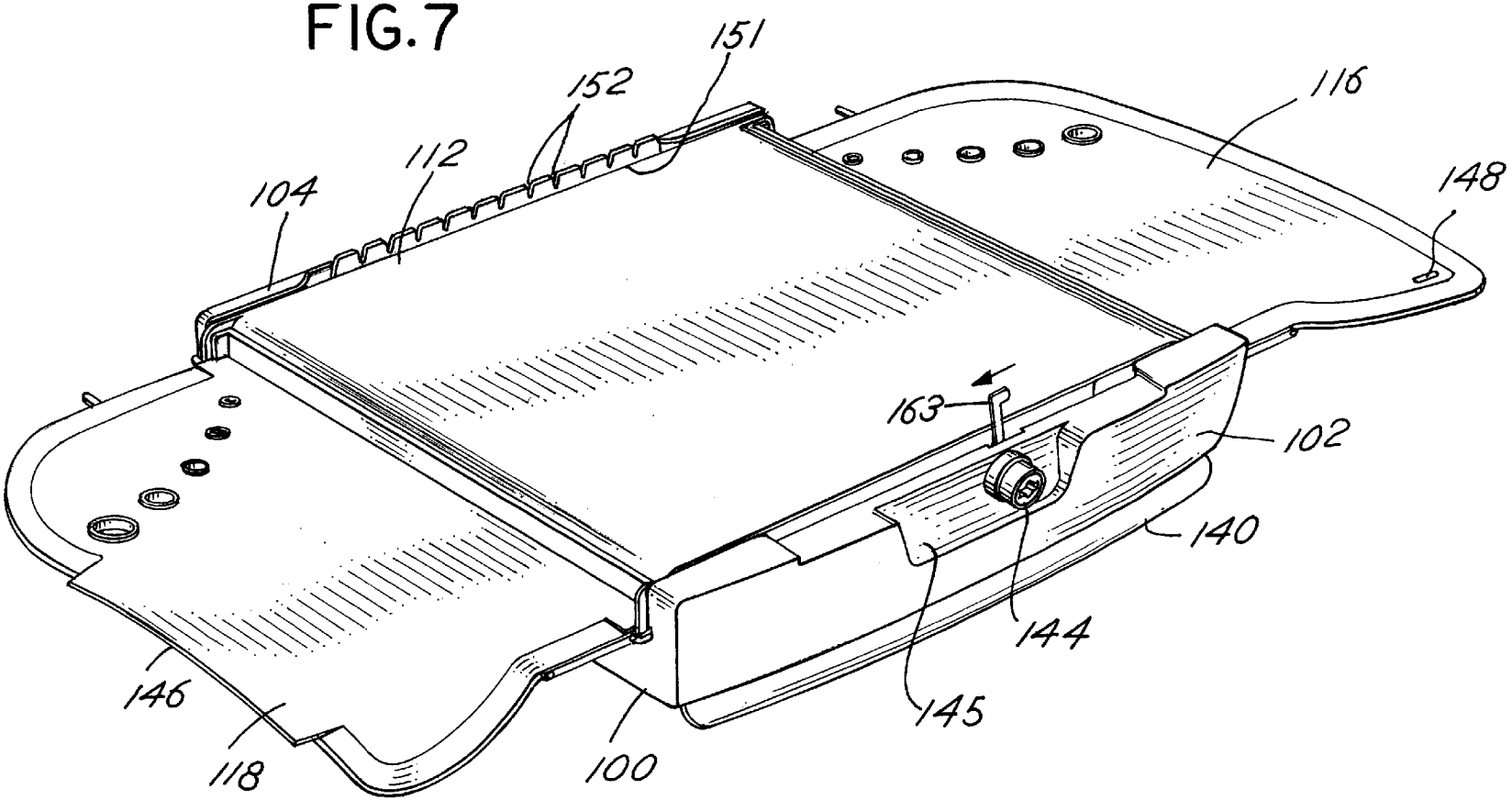
FIG. 7 is an isometric view of a first alternative embodiment of the invention.
Figure 11:
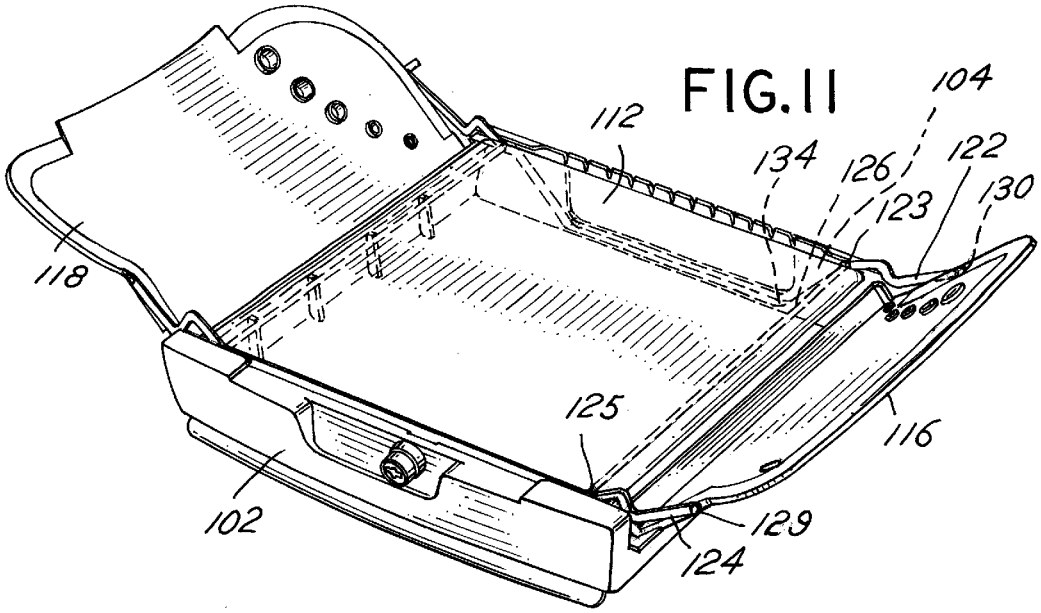
FIG. 11 is a further isometric view illustrating the opening the embodiment of FIG. 10 and, more particularly, the side platforms are opened approximately 135° and therein the linkage mechanism for raising the support platform within the security case is depicted.
Figure 12:
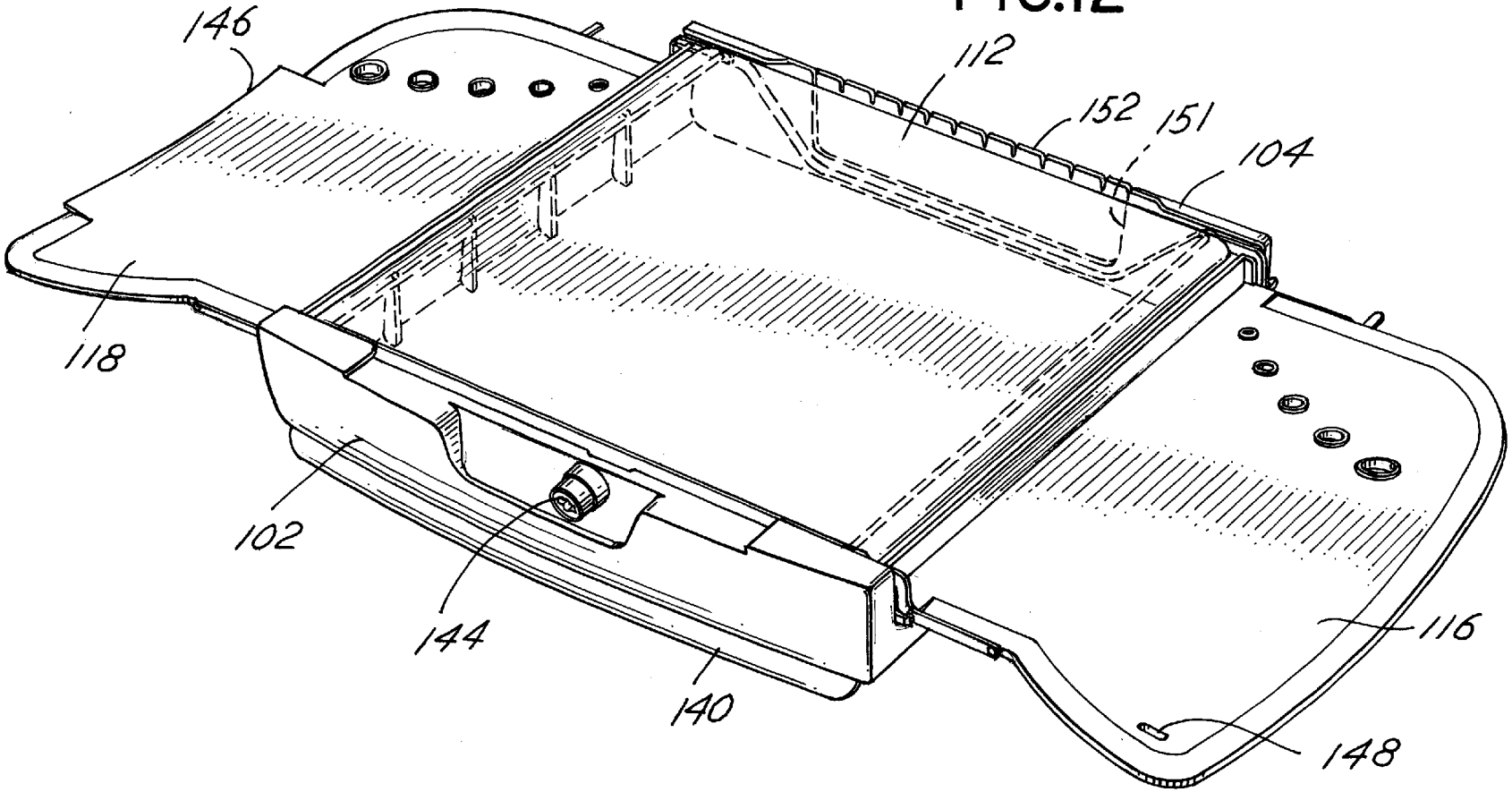
FIG. 12 is an isometric view illustrating the movement of the side platforms of the figure to the fully opened position to form first and second planar support surfaces.

A cam and linkage bar assembly is provided to move the support plate 112 between a storage position within the case and an elevated position depicted in FIG. 7 for supporting a personal computer or other item thereon. The linkage mechanism for each platform 116, 118 includes, as depicted in FIG. 11, a first linkage arm 122 and a second linkage arm 124 arranged respectively for each platform 116, 118 on opposite sides of each pivotal side platform 116, 118. The linkage arm 122 is connected to the linkage arm 124 by means of a transverse rod 126. The linkage arm 124 is also pivotally connected at pivot connection 129 to one side of the first platform 116 or second platform 118 as the case may be. This pivot connection 129 is aligned with a pivotal connection 130 on the opposite side of the platform 116 or 118. The opposite end 123, 125 of each linkage arm 122 and 124 functions, respectively, as cam followers, or cam members. The cam followers or linkage arm ends 123 and 125 engage respectively a cam track 134 formed in the back panel 104 and a cam track 136 molded or formed in the front panel 102. In this matter, as followers or ends 123, 125 move along tracks 134, 136, the cross bar 126 is raised as each lateral side panel or platform 116 or 118 is pivoted from the closed position toward the open position. Thus, the bar 126 will engage against the underside of the support platform 112 causing the platform 112 to be simultaneously raised as the lateral platforms 116, 118 are pivoted. The movement of the platform 112 is illustrated in sequence by FIGS. 8–12.

When the support platform 112 is in the fully opened position, as illustrated in FIG. 7 due to the pivoting action of the lateral platforms 116 and 118, the plate 112 is transported to a height above the base plate 102 thereby raising and supporting the personal computer or other item from the interior of the case for access. The linkage arms 122 and 124 are arranged or shaped so that they, in combination with cam tracks 134, 136, will cause the cross bar 126 to engage against the underside of the support platform 112 to raise or lower the platform 112.

Various additional features are incorporated in the alternative embodiment, for example, an integrated pull handle 140 is formed in the front panel 102 along the bottom edge thereof. The front panel 102 may also be removable or may include a separate removable center section or element of the case, for example, by actuation of a lock mechanism 144 for easy replacement of the front panel or a portion thereof. The side platform 118 preferably includes a lateral side edge or lip 146 which fits under the edge of side platform 116 when the panels 116, 118 are in the closed position. This facilitates maintaining the case in a locked condition inasmuch as the lock 144 will pivot a strike 163 into a bolt opening 148 when the platforms or panels 116, 118 are closed, thereby holding both of the lateral side panels or platforms 116 and 118 in the closed position.

The back panel 104 includes one or more openings 150 adapted to receive cables and other wires leading into the computer. A middle opening 150 in back panel 104 does not, of course, extend across the entire back panel 104 of the case inasmuch as it is necessary to prevent removal of the computer or other items from within the case. The support platform 112 may also include a series of cable guide slots 152 along the rear edge 151 to facilitate placement and protection of cables for cooperation with a personal computer (PC) retained within the case. Note the cables may be connected to a PC when the case is closed as well as open.

As depicted in FIG. 8, holes 154 may be provided in the platforms 116 and 118 for ventilation and the flow of air into the case, particularly when the case is in the closed position. The front panel 102 includes a recess 145 in which the lock 144 is positioned as described above. The recess 145 provides a region into which the front edge 166 of one or both platforms 116, 118 may overlap to permit access for engagement and movement of the lateral side platforms 116, 118 from the closed to the opened position.

Figure 13:
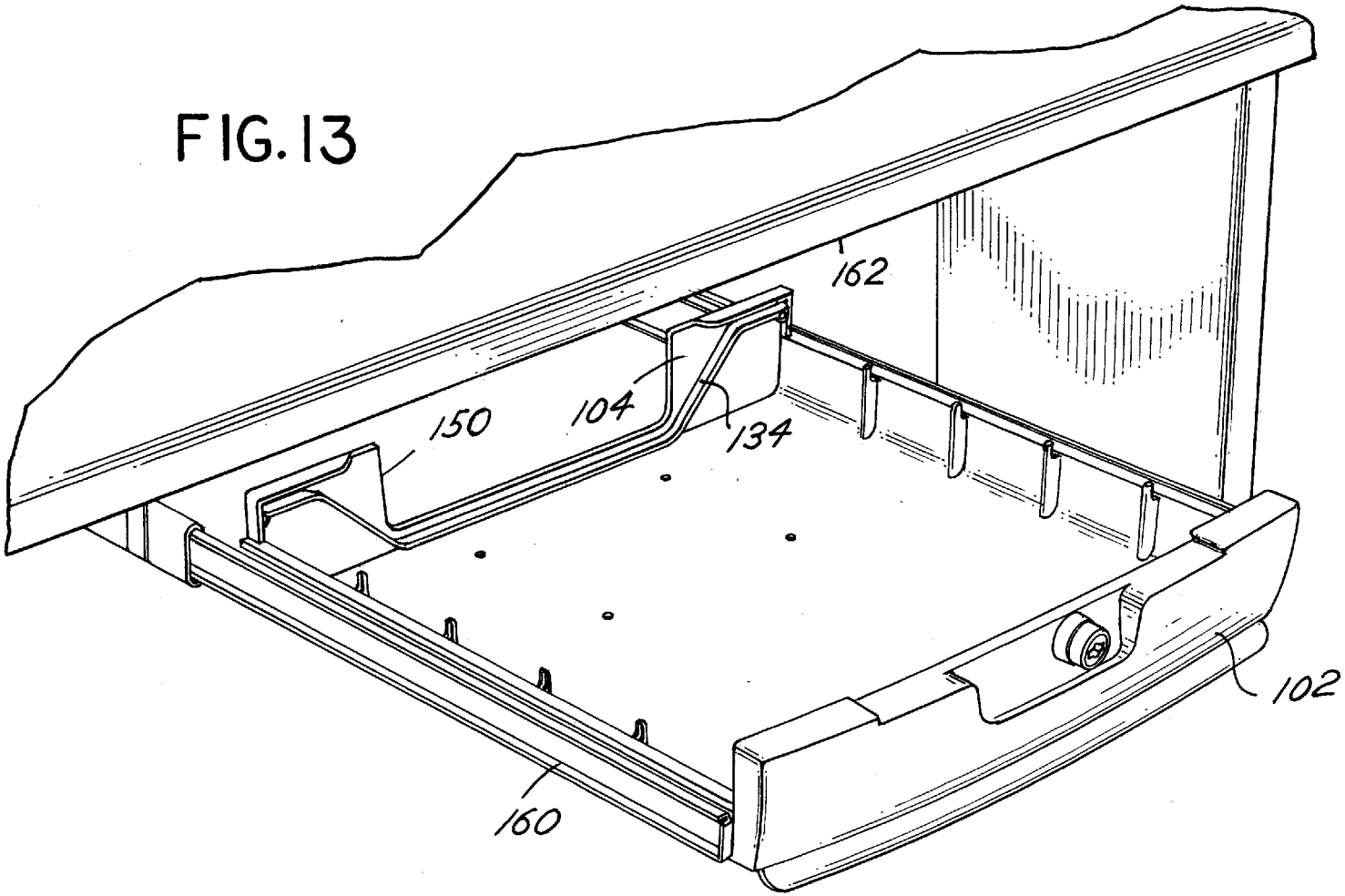
FIG. 13 is an isometric view of the FIG. 10 embodiment illustrating the manner in which the security case of the invention may be supported by drawer slides at a workstation supported beneath a work platform or desk.
Figure 14:
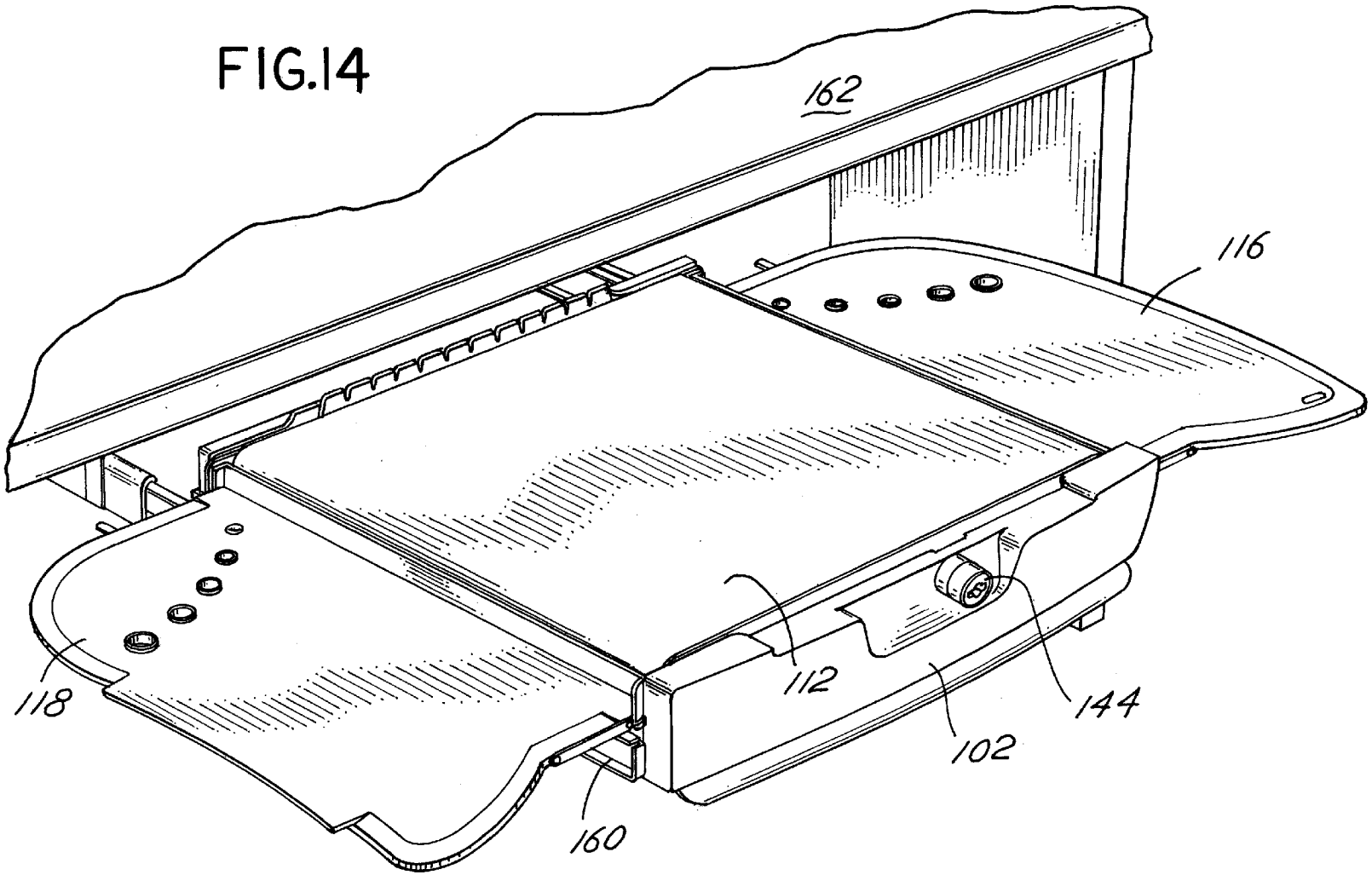
FIG. 14 is an isometric view of the workstation of FIG. 13 with the security case in a position retracked from beneath the work platform or desktop.
Figure 15:
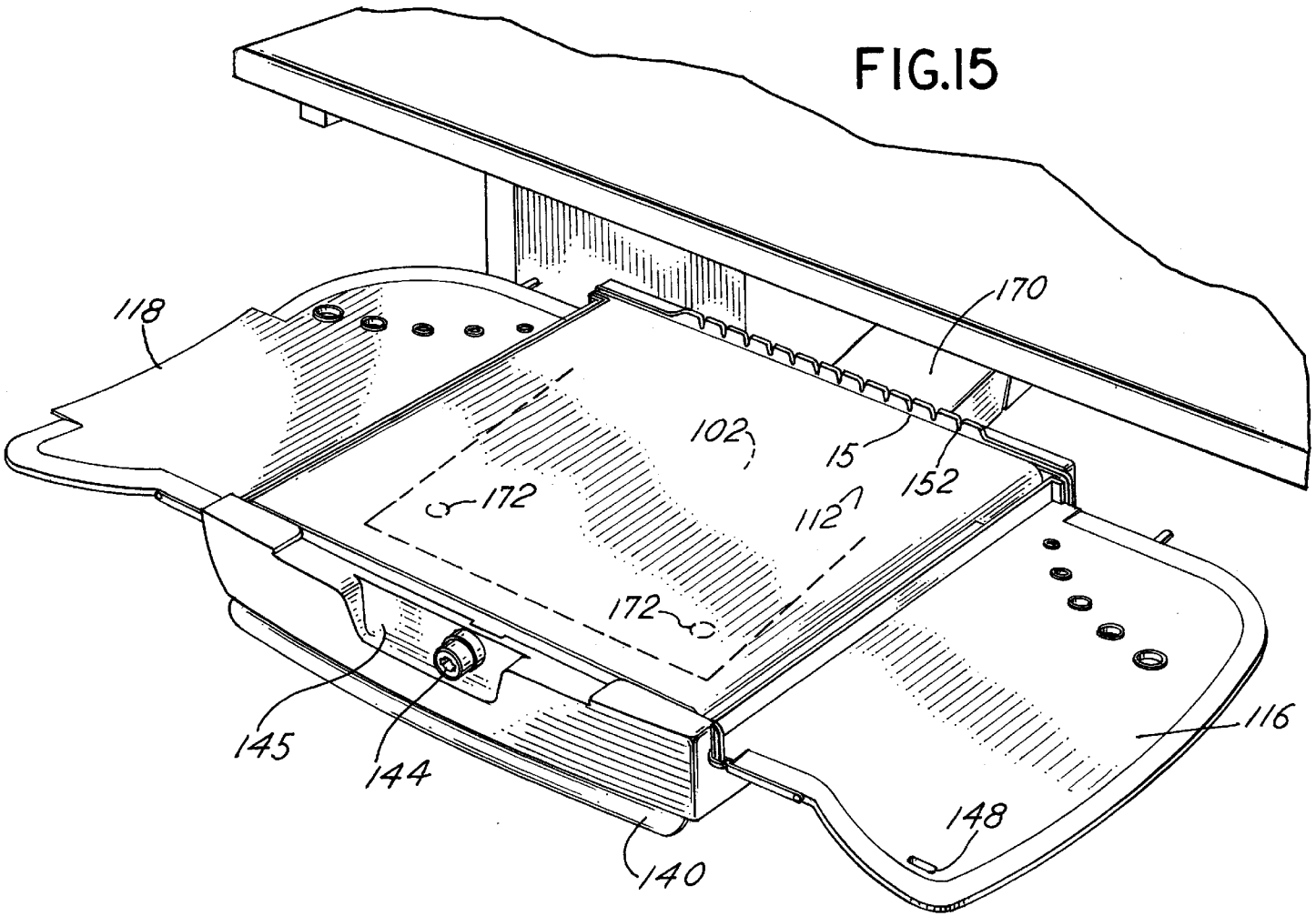
FIG. 15 is an isometric view of the embodiment of FIG. 7 incorporated with a keyboard support platform and support arm in a manner similar to the support assembly depicted in FIG. 1.

The computer case may be mounted in a number of environments. FIGS. 13–15 illustrate some of the options. In FIG. 13 the computer case is mounted on drawer slides 160 affixed to the underside of a table 162. The drawer slides 160 are attached to the opposite lateral sides of the computer case, thereby permitting the case to be closed and stored under the table 162. The computer case may thus slide underneath the top of table 162 when in the fully closed position. When in the open position as illustrated in FIG. 14, the computer mounted on the support platform 112 will not easily slide under the table. Thus, the drawer slides 160 may include a lock and release mechanism to insure that the computer case cannot be moved under the table 162 unless that release mechanism is actuated. Placement of the case on slides facilitates placement of the PC in an ergonomically beneficial position relative to the top of a desk or table.

FIG. 15 illustrates another alternative mounting mechanism for the computer case similar to the mechanism depicted in FIG. 1. In this arrangement, the support base 102 is mounted, for example, by fasteners 172 on a keyboard platform of a keyboard support arm 170, which is movable between a position beneath a table top and a position as depicted in FIG. 15. Typically, keyboard support arms are depicted, for example, in U.S. Pat. Nos. 5,037,054, 5,145, 136, and 5,257,767 incorporated herewith by reference. Such a mounting arrangement enables adjustment of the PC by an individual to a desired attitude or angle and height while maintaining security when the case is closed and the PC is hidden from view and access.

Figure 16:
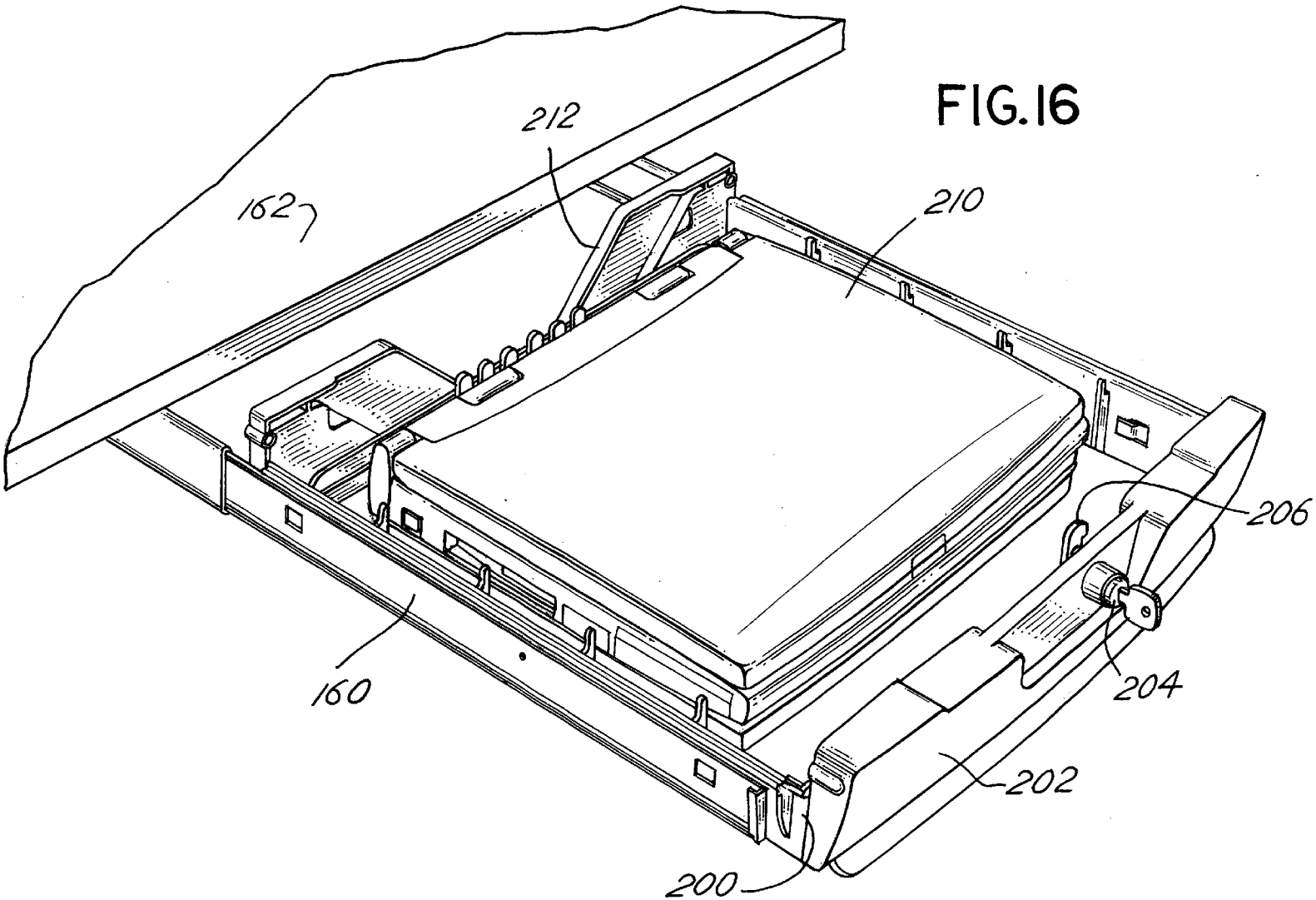
FIG. 16 is an isometric view of an alternative use of the tray or drawer element of the case in combination with drawer slides.
Figure 17:
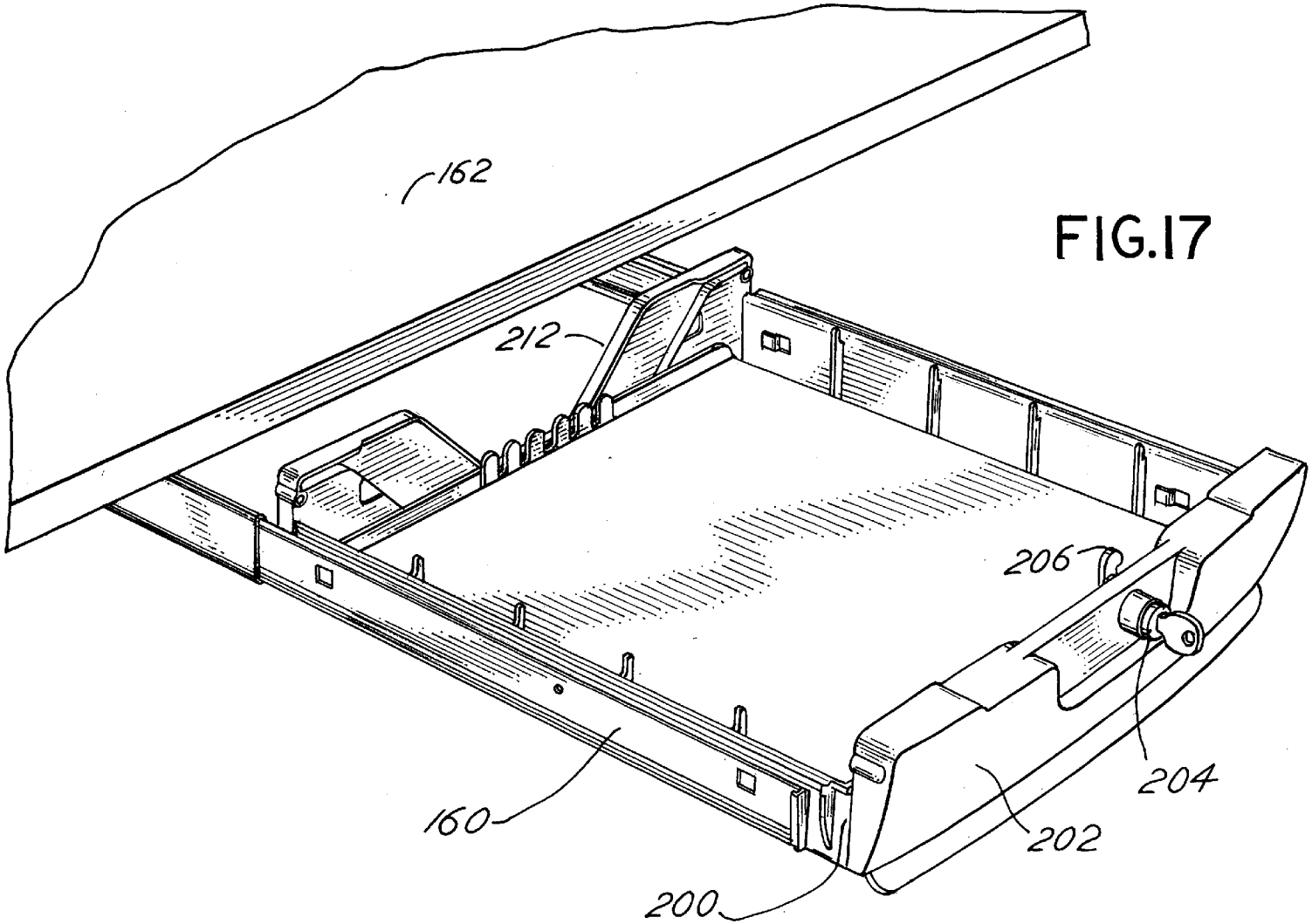
FIG. 17 is an isometric view of the empty tray of the embodiment of FIG. 16.

FIGS. 16 and 17 illustrate an alternative use of the embodiment illustrated in the prior figures. The alternative use comprises a variation of the use and arrangement depicted in FIG. 14. More specifically, as shown in FIG. 16, the case defines a drawer or tray 200 having a front side panel 202 with a key actuated cylinder lock 204 which operates a bolt 206. The sides of the tray 200 are attached to slides 160 to enable the tray to be mounted under a platform 162. The tray 200 may then slide into and out of a position beneath the platform 162 just as the configuration of FIG. 14. The tray 200 excludes the pivotal side platforms and the mechanism associated therewith. The tray 200 thus serves as a drawer for security for a personal computer 210 stored therein. The bolt 206 is designed to engage with a strike on the underside of the platform 162. As a consequence, by minor disassembly of the protective case construction, one is provided with a protective drawer in which the personal computer 210 may be stored with the inclusion of an opening at the backside of the tray 200; namely, an opening 212 for receipt of cords for powering and for connecting with the personal computer 210 within the tray 200. FIG. 17 illustrates the construction of the tray 200 wherein the personal computer 210 has been removed therefrom.

There has been set forth a preferred embodiment of the invention. Other embodiments incorporating in the features of the described invention may be provided. The construction of the camming surface, the shape and depth of the base plate 12, the shape and lateral or side to side extent of the platforms 40 and 70, the position and construction of the lock 74, and the construction of the front panel 16 and whether it is hinged or unhinged may all be varied without departing from the spirit and scope of the invention. Further, the case of the invention may be mounted on a keyboard support arm, on drawer slides, or on a counter, table or pedestal. The invention is therefore to be limited only by the following claims and equivalents thereof.

What is claimed is:

1. A storage and security case for a personal computer comprising, in combination:

a base plate having a profile with a first lateral side edge, a second lateral side edge spaced from the first lateral side edge, a front edge and a back edge;

a first side platform pivotally attached to the first one of said base plate lateral side edges, said first side platform pivotal about the first lateral side edge between a position over the base plate and a position laterally to the base plate;

a support plate positioned over the base plate and having a support plate profile within the profile of the base plate; and a lift linkage member connected to the first side platform side edge whereby pivotal rotation of the side platform from a position over the base plate to a position exposing the base plate causes the lift linkage member to raise the support plate from the base plate to a position above and spaced from the base plate.

2. The case of claim 1 wherein the base plate includes an outside and including attachment members on the base plate outside for attachment of the case to a platform.

3. The case of claim 1 including a front panel at the front edge of the base plate extending upwardly to restrict access to the base plate and the support platform from the front edge.

4. The case of claim 3 wherein the front panel is pivotal about the front edge of the base plate.

5. The case of claim 4 wherein the front panel includes an inside and an outside and wherein the inside includes a wrist support pad.

6. The case of claim 3 further including a cam mechanism for moving the front panel between an upwardly extending position and a position which provides access to the base plate.

7. The case of claim 1 including a back panel at the back edge of the base plate extending upwardly to restrict access to the base plate and the support platform from the back edge.

8. The case of claim 1 wherein the side platform pivots to cover the support plate.

9. The case of claim 1 including a lock mechanism for locking the side platform over the base plate.

10. The case of claim 1 including panels mounted on the base plate for maintaining the position of the support plate within the profile of the base plate as the support plate is raised from the base plate.

11. The case of claim 1 including a stop mechanism for holding said side platform in a position lateral to the side plate.

12. The case of claim 1 wherein the lift member comprises a linkage connected to the side platform and a cam member to guide the linkage, and said side platform being pivotal about an axis extending along the lateral side edge and above the plane of the base plate.

13. The case of claim 1 further including a slide attachment mechanism attached to the side edges for slidably mounting the case.

14. The case of claim 1 in combination with a slide assembly attached to the case for telescopically mounting the case.

* * * * *